United States Patent [19]

Fujiwara et al.

[11] Patent Number: 4,711,443

[45] Date of Patent: Dec. 8, 1987

[54] SHEET SUPPLY DEVICE

[75] Inventors: Tsutomu Fujiwara; Susumu Matsuda; Keisuke Murakami; Izumi Ogawa; Mamoru Tago; Chihiro Aoki; Masahiro Doi; Hiroshi Anno, all of Shizuoka, Japan

[73] Assignee: Tokyo Electric Co., Ltd., Tokyo, Japan

[21] Appl. No.: 927,953

[22] Filed: Nov. 7, 1986

[30] Foreign Application Priority Data

Nov. 7, 1985 [JP] Japan ..... 60-249754
Oct. 3, 1986 [JP] Japan ..... 61-152347[U]

[51] Int. Cl.[4] ..... B65H 1/08
[52] U.S. Cl. ..... 271/126; 271/148
[58] Field of Search ..... 271/148, 126, 127; 414/30

[56] References Cited

U.S. PATENT DOCUMENTS 4,042,124 8/1977 Bowdry ..... 414/30
4,585,225 4/1986 Miura ..... 271/215 X

*Primary Examiner*—Richard A. Schacher
*Attorney, Agent, or Firm*—Oblon, Fisher, Spivak, McClelland & Maier

[57] ABSTRACT

The sheet supply device comprises a sheet stocker including a lifting table mounted for up and down movement with a large number of sheets accumulated in layers thereon which sheets are different in thickness between opposite sides thereof and a paper feed roller for contacting with an uppermost one of the sheets, a string having one end fastened to each of opposite sides of the lifting table corresponding to the opposite sides of the sheets providing the difference in thickness, a first take-up drum or drums located corresponding to the thicker side of the sheets and each having the other end of the string corresponding to the thicker side of the sheets fastened thereto, a second take-up drum or drums located corresponding to the thinner side of the sheets and each having the other end of the string corresponding to the thinner side of the sheets fastened thereto.

11 Claims, 12 Drawing Figures

SHEET SUPPLY DEVICE

FIELD OF THE INVENTION AND RELATED ART STATEMENT

This invention relates to a sheet supply device for supplying one after another of a plurality of sheets accumulated in layers, and more particularly to a sheet supply device adapted to handle such sheets that will be inclined when they are accumulated in layers.

An example of conventional sheet supply devices is shown in FIG. 11. The sheet supply device shown includes a frame 60 in the form of a casing, and a lifting table 62 mounted for up and down movement in the frame 60 for supporting a large number of sheets 61 accumulated in layers thereon. A pair of string members 63 such as wires are fastened at one ends thereof to opposite sides of the lifting table 62 and at the other ends thereof to take-up drums 64 mounted for rotation on the lifting frame 60. A pair of paper feed rollers 65 are located for contact with an uppermost one of the accumulated sheets 61 adjacent a top opening of the frame 61. The paper feed rollers 65 are positioned at different vertical positions.

On the sheet supply device having such a construction as described above, the lifting table 62 is lifted step by step by taking up the string members 63 onto the take-up drums 64, and an upper most one of the sheets 61 is supplied to a predetermined portion of the device by the paper feed rollers 65.

Here, the sheet 61 may be of the type which is different in thickness between opposite sides thereof. For example, it may be a magnetic card having a magnetic stripe formed along only one side thereof or a paper sheet having a thick ink film printed on only one side thereof. Accordingly, if a large number of such sheets 61 are accumulated in layers, uppermost ones of the sheets 61 will be inclined remarkably. This is the reason why the two independent paper feed rollers 65 in the device shown in FIG. 11 are disposed in different vertical positions for engagement with the sheets 65 independently of each other. This allows contact of the feed rollers 65 in an increased area with the sheets 61.

Meanwhile, another example of a conventional paper supply device in which a paper feed roller is adapted to inclined sheets is shown in FIG. 12. In the device shown in FIG. 12, a paper feed roller 66 has an axis thereof disposed in an inclined relationship. In this arrangement, the paper feed roller 66 will contact over an entire length thereof with accumulated sheets 61, assuring a close contacting condition between them.

Drawbacks or disadvantages of such conventional devices will be described below. In the device shown in FIG. 11, the paper feed rollers 65 will each contact at a portion adjacent one end thereof with the inclined sheets 61 because they are disposed individually in horizontal positions. Accordingly, slippage may readily appear between the sheets 61 and the paper feed rollers 65, and hence the device of FIG. 11 has a drawback that a good paper feeding condition cannot be attained. It is another drawback that a drive mechanism for driving the paper feed rollers 65 is complicated and has a large size because the paper feed rollers 65 must be driven individually due to offset arrangement of axes thereof.

Meanwhile, in the device shown in FIG. 12, it is a drawback that a support structure for the paper feed roller 66, for example, a mounting structure for bearings not shown, is complicated and hence its production is difficult because the axis of it must be disposed in an inclined relationship.

OBJECTS AND SUMMARY OF THE INVENTION

It is a first object of the present invention to provide a sheet supply device wherein an uppermost one of accumulated sheets is always held in a parallel relationship to an axis of a paper feed roller.

It is a second object of the invention to provide a sheet supply device wherein a support structure for a paper feed roller is simple in construction and easy to produce.

It is a third object of the invention to provide a sheet supply device wherein a mechanism for lifting a lifting table is simplified in construction with a reduced quantity of components.

In order to attain those objects, according to the present invention, there is provided a sheet supply device, comprising a sheet stocker including a lifting table for receiving a large number of sheets accumulated in layers thereon, the sheets being different in thickness between opposite sides thereof, said sheet stocker further including a paper feed roller for contacting with an uppermost one of the sheets on said lifting table, one or more string members having one end or ends fastened to each of opposite sides of said lifting table corresponding to the opposite sides of the sheets providing the difference in thickness, a first take-up drum or drums located corresponding to the thicker side of the sheets and having the other end or ends of those of said string member or members corresponding to the thicker side of the sheets fastened thereto, a second take-up drum or drums located corresponding to the thinner side of the sheets and having the other end or ends of those of said string member or members corresponding to the thinner side of the sheets fastened thereto, and a lifting inclining means for causing said first take-up drum or drums to take up the string member or members at a higher taking up speed than the taking up speed at which said second take-up drum or drums take up the string member or members.

Thus, the lifting inclining means holds the lifting table in a horizontal position when it is in its most lifted position and gradually inclines the lifting table as it is lowered. Accordingly, where sheets to be supplied have a difference in thickness between opposite sides thereof and hence an uppermost one of such sheets assumes an inclined position when a large number of such sheets are accumulated in layers, the sheets will be placed on the lifting table in an inclined position so that the uppermost sheet will contact in parallel with the paper feed roller. Then, as the quantity of the sheets left decreases, the inclination of the lifting table decreases while parallel condition between a currently uppermost sheet and the paper feed roller is maintained. Accordingly, possible slippage between sheets and the paper feed roller can be prevented, which assures regular forwarding of the sheets. Besides, a support structure for the paper feed roller is simple and easy to produce.

DESCRIPTION OF THE PREFERRED EMBODIMENTS

Figure 3:
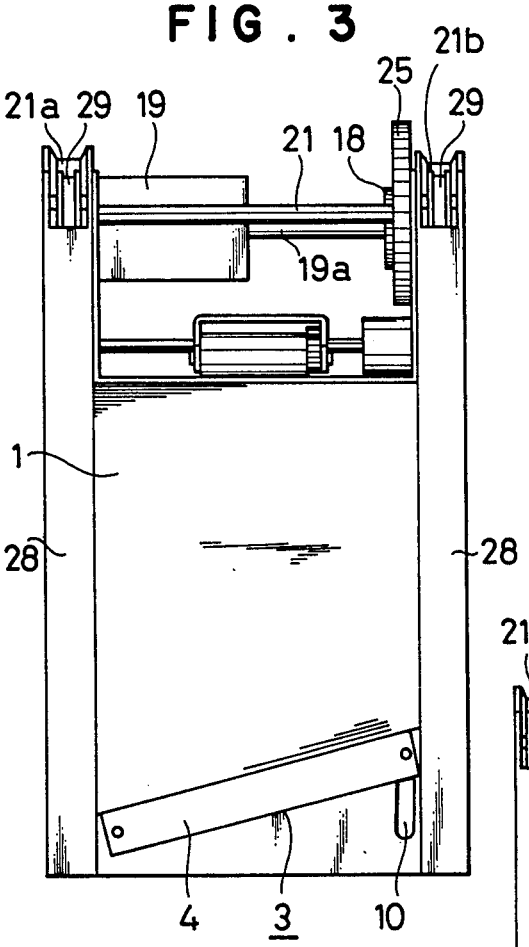
FIG. 3 is a front elevational view showing the inside of a sheet stocker when a lifting table is at a most lowered position.
Figure 4:
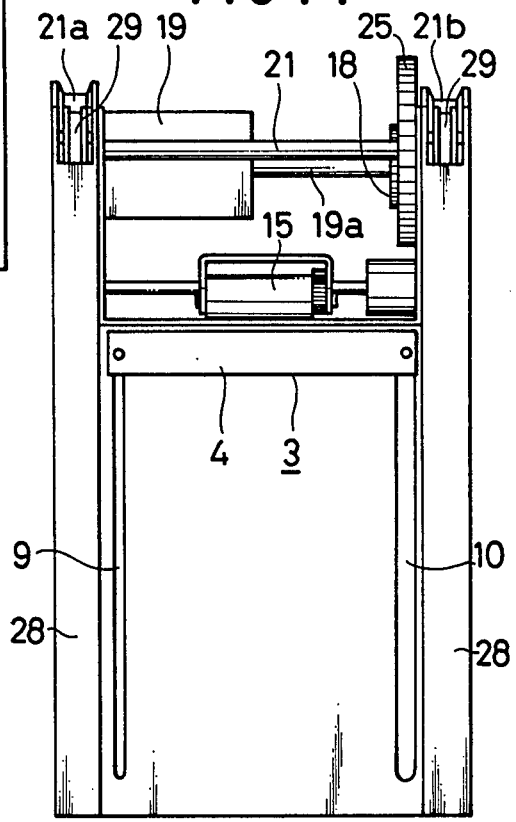
FIG. 4 is a similar view but illustrating the inside of the sheet stocker when the lifting table is at a most lifted position.
Figure 5:
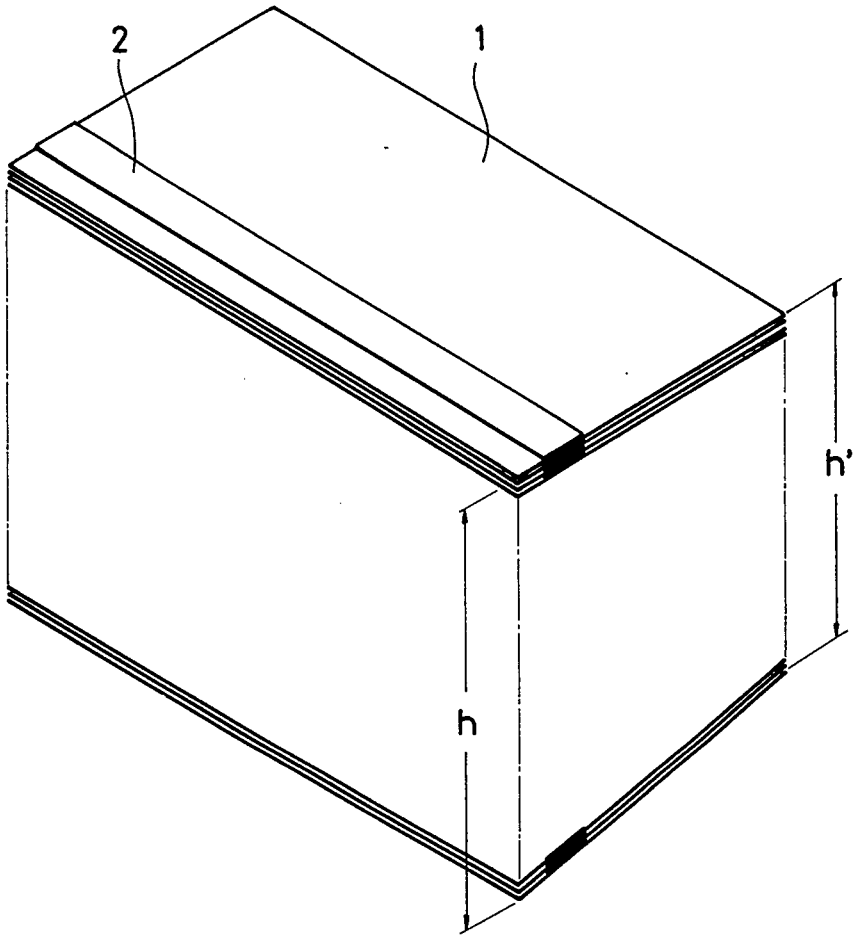
FIG. 5 is a perspective view showing sheets accumulated in layers.

At first a first embodiment of the present invention will be described with reference to FIGS. 1 to 5. As shown in FIG. 5, a large number of sheets 1 to be supplied by a sheet supply device are accumulated in layers and each have a magnetic stripe 2 formed along one side thereof.

The sheet supply device shown includes a channel-shaped support plate 5 located above a sheet stocker 3, and a lifting table 4 mounted for up and down movement below the support plate 5. The lifting table 4 has a pair of pins 6 erected at opposite ends of one side thereof and another pair of second pins 7 erected at opposite ends of the other side thereof. A pair of vertically elongated guide slots 9 having a width substantially equal to the diameter of the pins 6 are formed in opposite holding walls 8 of the sheet stocker 3, and the pins 6 are received in the guide slots 9. Another pair of vertically elongated second guide slots 10 having a width greater than the diameter of the second pins 7 are also formed in the holding walls 8 of the sheet stocker 3, and the second pins 7 are received in the second guide slots 10. Meanwhile, a roller shaft 12 extends between and is supported for rotation by opposite walls of the support plate 5 and is connected to be driven by a motor 11. A gear wheel 13 is secured to the roller shaft 12, and a roller bail 14 is supported for pivotal motion on the roller shaft 12. The roller bail 14 has a paper feed roller 15 and a gear wheel 16 both secured to a shaft mounted for rotation thereon and is urged to move the paper feed roller 15 toward the bottom of the support plate 5. Another gear wheel 17 is supported for rotation on the roller bail 14 and is held in meshed engagement with the gear wheels 13 and 16.

A lifting motor 19 serving as a driving source for moving the lifting table 4 up and down is mounted on the support plate 5, and a pair of drive shafts 20, 21 are mounted for rotation on the support plate 5 in parallel relationship to a rotary shaft 19*a* of the lifting motor 19. A drive gear wheel 18 is secured to the rotary shaft 19*a*, and a lifting gear wheel 22 is secured to the drive shaft 20 and held in meshed engagement with the drive gear wheel 18. A first take-up drum 20*a* and a second take-up drum 20*b* are secured to opposite ends of the drive shaft 20. Another lifting gear wheel 25 is secured to the other drive shaft 21 and held in meshed engagement with the lifting gear wheel 22. The drive shaft 21 also has a first take-up drum 21*a* and a second take-up drum 21*b* secured to opposite ends thereof. The sheet stocker 3 has support posts 28 at four corners thereof, and a pulley 29 is mounted for rotation at the top end of each of the support posts 28. A pair of string members 30 such as wires extend around the pulleys 29 between and have opposite ends thereof fastened to the first take-up drums 20*a*, 21*a* and the respective associated pins 6 of the lifting table 4. Another pair of string members 30 extend around the pulleys 29 between and have opposite ends thereof fastened to the second take-up drums 20*b*, 21*b* and the respective associated second pins 7 of the lifting table 4.

Figure 1:
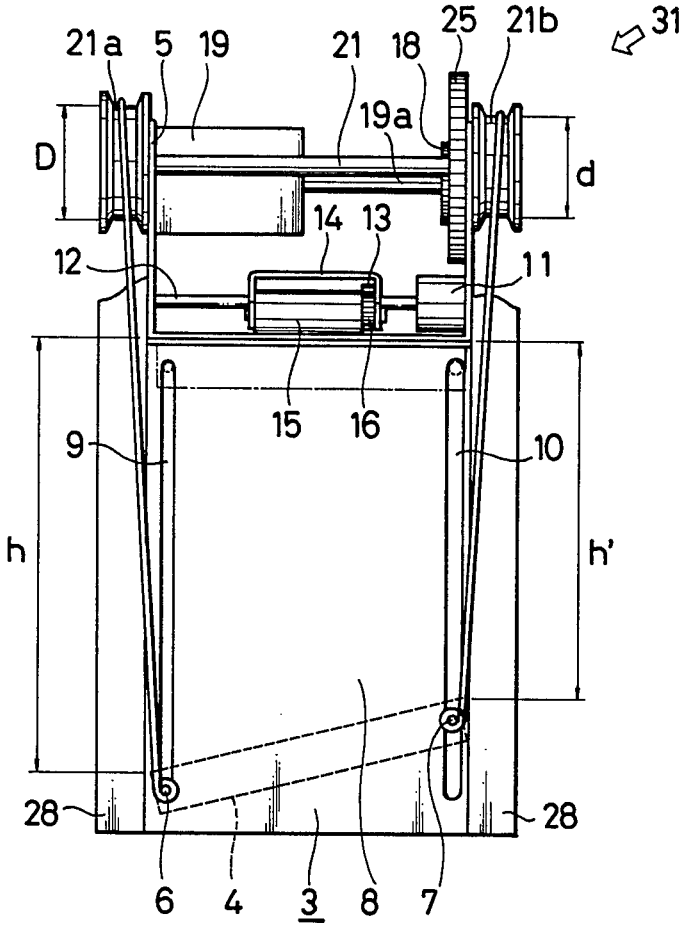
FIG. 1 is a front elevational view of an entire paper supply device illustrating a first embodiment of the present invention.
Figure 2:
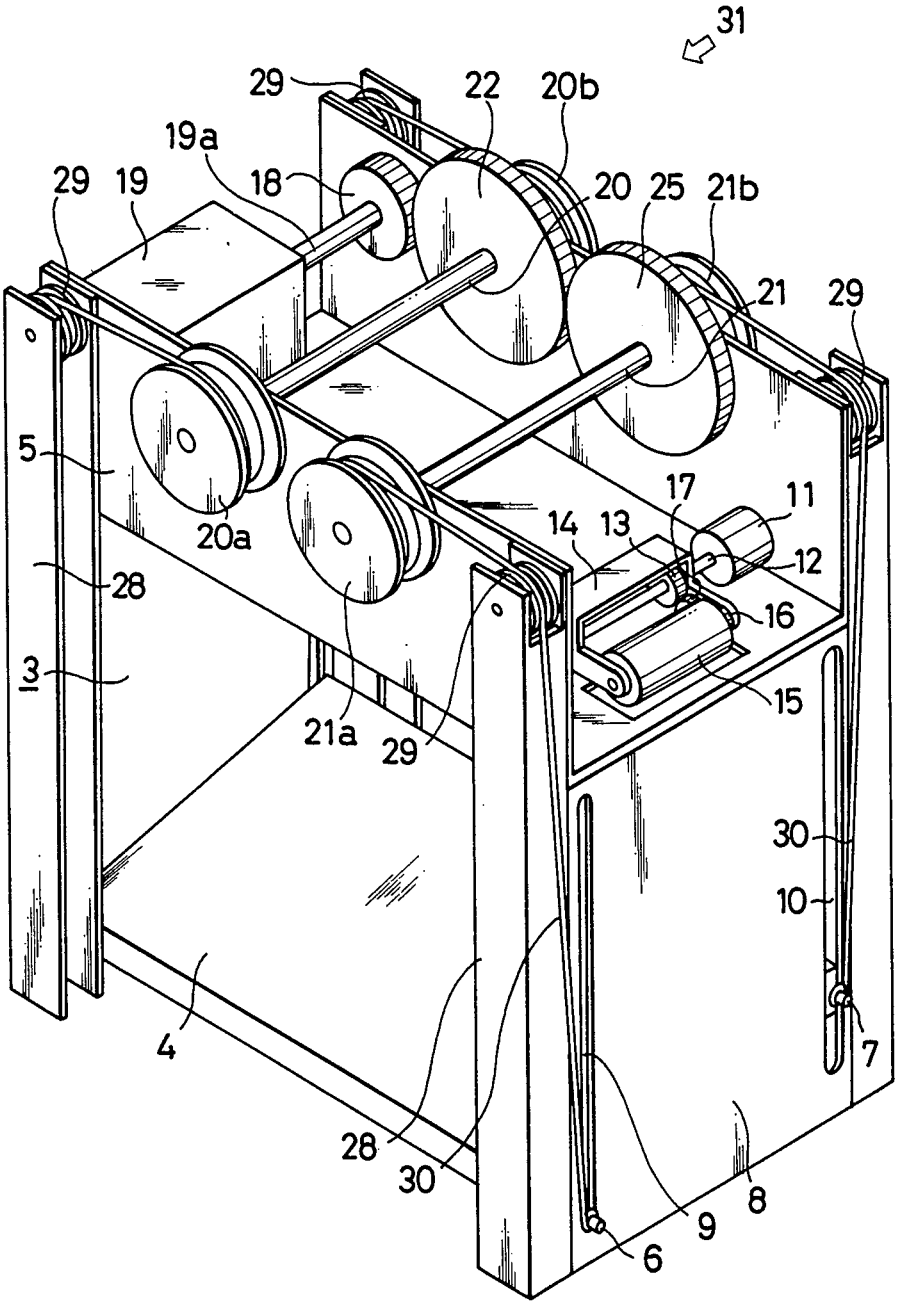
FIG. 2 is a perspective view of the device of FIG. 1.

Meanwhile, since each of the sheets 1 has a magnetic stripe 2 along one side thereof as shown in FIG. 5, if, for example, a quantity of 2,000 such sheets 1 are accumulated in layers, the heights h, h' at the one and the other sides of the sheets 1 will be different from each other. Accordingly, in order to hold an uppermost one of the sheets 1 in parallel with an axis of the paper feed roller 15, the lifting table 4 must be parallel to the axis of the paper feed roller 15 when the lifting table 4 is in its most lifted position whereas it must be inclined downwardly at a side thereof adjacent the pins 6 when it is in its most lowered position. Accordingly, the height of the lifting table 4 to be lifted is to be h on the pin 6 side and h' on the second pin 7 side as illustrated in FIG. 1.

By the way, the first take-up drums 20*a*, 21*a* and the second take-up drums 20*b*, 21*b* each take up a string member 30 in a single layer so that it may not overlap itself. Thus, if the outer diameter of the second take-up drums 20*b*, 21*b* adjacent the thinner side of the sheets 1 is represented by d and that of the first take-up drums 20*a* adjacent the opposite side of the sheets 1 is represented by D, a relationship $d=h'D/h$ is established between them. Accordingly, the outer diameter of the first take-up drum 20*a*, 21*a* and hence the length of the string members 30 to be taken up by them in one full rotation of the same are greater than those of and by the second take-up drums 20*b*, 21*b* on the other side, thus constituting a lifting inclining means 31. Accordingly, in the lifting inclining means 31, the speed in taking up the string members 30 by the first take-up drums 20*a*, 21*a* is higher than that by the second take-up drums 20*b*, 21*b*.

With the construction described above, as rotation of the motor 11 is transmitted to the paper feed roller 15 via the gear wheels 13, 17, 16, the paper feed roller 15 is rotated to forward an uppermost one of the sheets 1 to a predetermined position. The predetermined position may be, for example, a magnetically recording station (not shown) in which data is written on the magnetic stripe 2 of the thus forward sheet 1. The sheet 1 may be subsequently advanced, for example, to a printing station (not shown) in which data is printed thereon.

In order to successively contact a currently uppermost one of the sheets 1 with the paper feed roller 15, rotation of the lifting motor 19 is transmitted to the drive gear wheel 18 and the lifting gear wheels 22, 25 to rotate the first take-up drums 20*a*, 21*a* and the second take-up drums 20*b*, 21*b* to lift the lifting table 4. In this instance, the lifting table 4 is inclined downwardly at a side thereof adjacent the magnetic stripe 2 side of the accumulated sheets 1 when it is at its most lowered position as shown in FIG. 3, but it assumes a position parallel to the axis of the paper feed roller 15 when it is lifted to its most lifted position as shown in FIG. 4. This is because the length of the string members 30 to be taken up for a unit number of rotations by the first take-up drums 20*a*, 20*a* adjacent the sides of the sheets 2 along which the magnetic stripes 2 are formed is greater than that by the second take-up drums 21*a*, 21*b* on the other side. Thus, such inclination of the lifting table 4 is attained by the lifting inclining means 31 in which the taking up speed of the string members 30 is different between opposite sides of the lifting table 4.

In this manner, according to the present embodiment, an uppermost one of the sheets 1 can always be held in parallel with the axis of the paper feed roller 15. Accordingly, normal forwarding state of the sheets 1 can be maintained. Besides, the support structure for the paper feed roller 15 is not complicated in construction, which facilitates production of sheet supply devices.

Further, since the string members 30 are each taken up in a single layer, an error in lifting the lifting table 4 by the string members 30 which error may possibly be caused by overlapping of the string members 30 is eliminated. Consequently, the inclined angle of the lifting table 4 as it is lifted is always held properly, which contributes to regular forwarding of the sheets 1.

In addition, although the inclination of the lifting table 4 changes as it is lifted, the position of one side thereof is defined by the guide slots 9 and the pins 9 slidably moving along the guide slots 9 and the lifting movement thereof is smooth because the second guide slots 10 have a greater width than the first guide slots 9.

Figure 6:
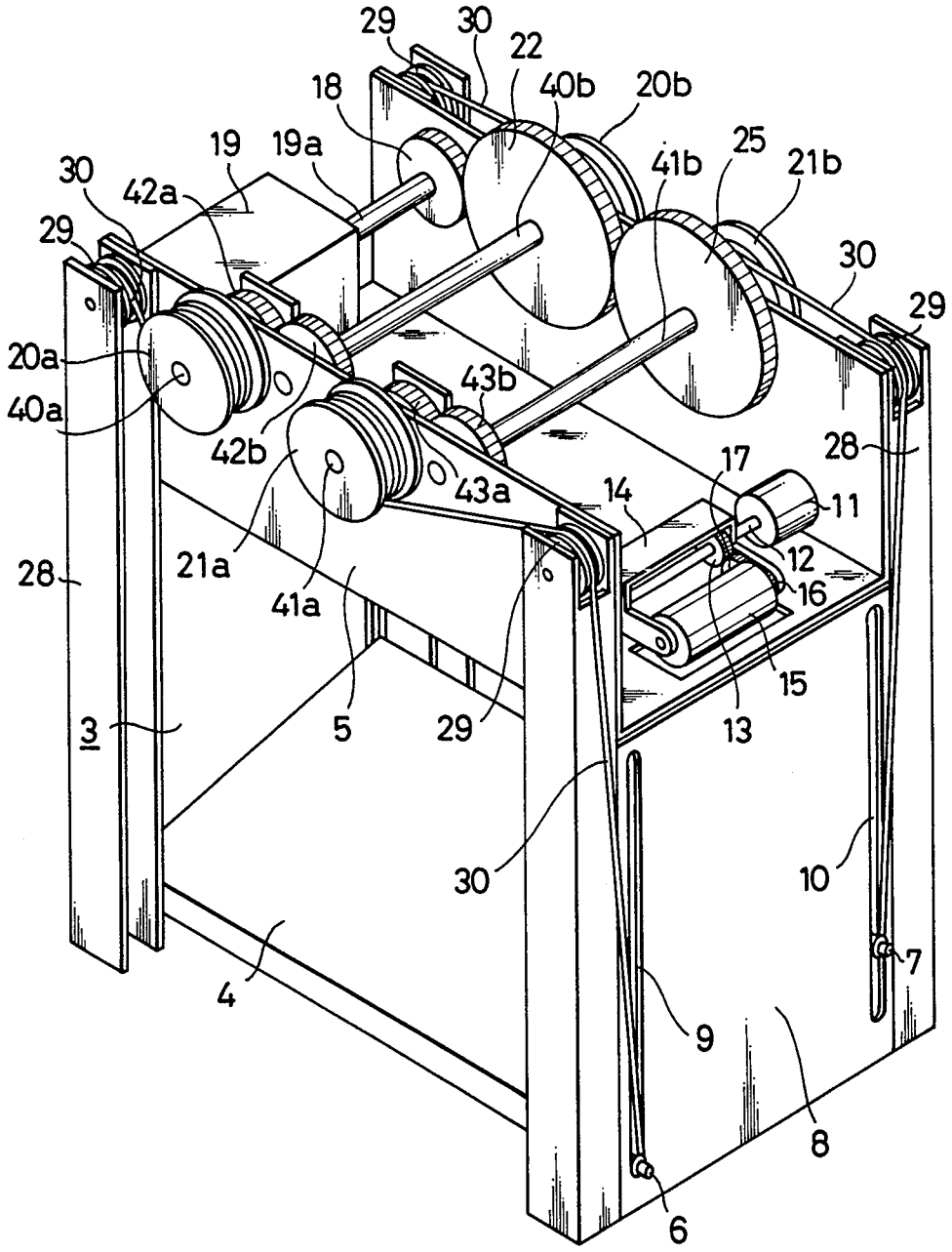
FIG. 6 is a perspective view of an entire paper supply device illustrating a second embodiment of the invention.
Figure 7:
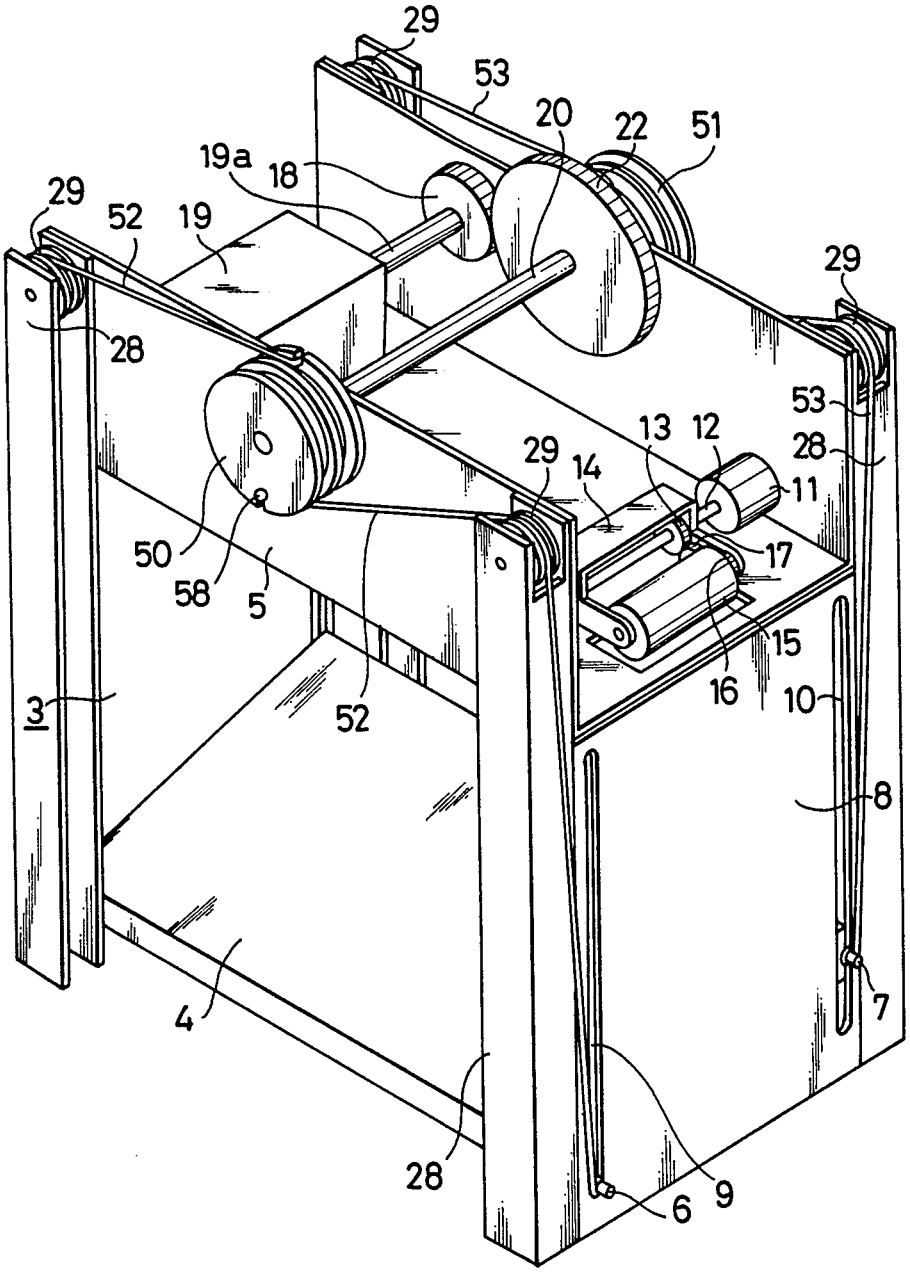
FIG. 7 is a similar view but illustrating a third embodiment of the invention.

Now, a second embodiment of the present invention will be described with reference to FIG. 6. In FIG. 6, like parts or components are denoted by like reference numerals to those of FIGS. 1 to 5 and description thereof will be omitted herein (this also applies to a third embodiment and its modification of the invention which will be described hereinbelow). In the embodiment shown in FIG. 6, first take-up drums 20*a*, 21*a* and second take-up drums 20*b*, 21*b* have a same outer diameter while drive shafts 20 and 21 are individually divided into two parts 40*a*, 40*b* and 41*a*, 41*b*, respectively, having offset but parallel axes relative to each other. The first take-up drums 20*a*, 21*a* are secured to the first drive shafts 40*a*, 41*a* while the second take-up drums 40*b*, 41*b* are secured to the second drive shafts 40*b*, 41*b*, respectively. First speed change gear wheels 42*a*, 43*a* are also secured to the first drive shaft 40*a*, 41*a*, respectively. A second speed change gear wheel 42*b* is secured to the second drive shaft 40*b* and held in meshed engagement with the first speed change gear wheel 42*a*, and another second speed change gear wheel 43*b* is secured to the second drive shaft 41*b* and held in meshed engagement with the first speed change gear wheel 43*a*.

The first speed change gear wheels 42*a*, 43*a* have a different size from and is actually smaller than the second speed change gear wheels 42*b*, 43*b*. In particular, if the size of the first speed change gear wheels 42*a*, 43*a* is represented by E and the size of the second speed change gear wheels 42*b*, 43*b* is represented by e, a relationship $E=h'e/h$ is established between them. Thus, a lifting inclining means 31 is constituted with such a gear ratio between the first speed change gear wheels 42*a*, 43*a* and the second speed change gear wheels 42*b*, 43*b*.

With the construction described above, as a lifting table 4 is lifted, the first take-up drums 20*a*, 21*a* rotate at a higher speed than the second take-up drums 20*b*, 21*b* due to the difference in gear ratio between the first speed change gear wheels 42*a*, 43*a* and the second speed change gear wheels 42*b*, 43*b*, respectively. Accordingly, the length of string members 30 taken up by the first take-up drums 20*a*, 21*a* is greater than that by the second take-up drums 20*b*, 21*b*, and thus the lifting table 4 is lifted with a similar inclination to that in the first embodiment described above.

Now, a third embodiment of the invention will be described with reference to FIGS. 7 to 10. In the embodiment shown, the first take-up drums 20*a*, 21*a* and the second take-up drums 20*b*, 21*b* of the first embodiment described above are replaced by a single first take-up drum 50 and a single second take-up drum 51, respectively. In particular, the first drive shaft 21 of the first embodiment is eliminated and a single drive shaft 20 is mounted at a mid portion of a support plate 5 naturally in parallel relationship to a rotary shaft 19*a* of a lifting motor 19. A lifting gear wheel 22 secured to the drive shaft 20 and a drive gear wheel 18 secured to the rotary shaft 19*a* are held in meshed engagement with a predetermined appropriate gear ratio. The first take-up drum 50 and the second take-up drum 51 are secured to opposite ends of the drive shaft 20. The first take-up drum 50 has two string members 52 fastened thereto which are fastened at the other ends thereof to two pins 6 on a lifting table 4 while the second take-up drum 51 also has two string members 53 fastened thereto which are fastened at the other ends thereof to two second pins 7 on the lifting table 4.

Figure 8:
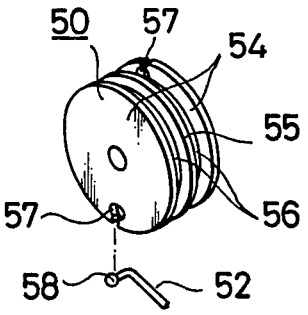
FIG. 8 is a perspective view of a take-up drum and portions of string members fastened to the take-up drum.
Figure 9:
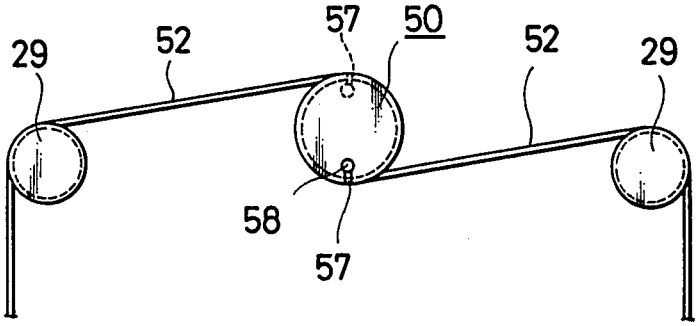
FIG. 9 is a side elevational view illustrating a relation between a location of the take-up drum and locations of the portions of the string members fastened to the take-up drum.

The first take-up drum 50 has, as shown in detail in FIG. 8, a pair of opposite flanges 54 and an intermediate flange 55 formed intermediate the flanges 54 and cooperatively defining two separate take-up portions 56 for directly taking up the string members 52 thereon. The two opposite flanges 54 each have a slot 57 formed therein and communicating with the adjacent winding portion 56. The slots 57 are located at symmetrical positions spaced by an angle of 180 degrees around the center of the first take-up drum 50. The size of the slots 57 is substantially equal to the diameter of the string members 52. Thus, an end portion of each of the string members 52 is bent in a direction of the slot 57 from the take-up portion 56 of the first take-up drum 50 and received in the slot 57 and terminates in a stopper 58 in the form of a ball having a size greater than the diameter of the string member 52. Thus, each of the string members 52 is fastened to the first take-up drum 50 by engagement of the stopper 58 thereof with the flange 54. Meanwhile, the second take-up drum 51 and the string members 53 have a basically identical construction and are only different in diameter of take-up portions of the second take-up drum 51. In particular, the diameter of the take-up portions of the first take-up drum 50 is greater than that of the second take-up drum 51, and the ratio between them is substantially identical with the ratio in diameter between the first and second take-up drums 20*a*, 21*a* and 20*b*, 21*b*.

With the construction described above, as the first take-up drum 50 and the second take-up drum 51 are driven to rotate by a lifting motor 19, the string members 52, 53 are independently taken up onto the two divided take-up portions 56 of the first and second take-up drums 50, 51. In this instance, since the string members 52, 53 are wound independently of each other, they do not at all overlap each other. Accordingly, the lifting table 4 maintains a parallel position in a forwarding direction of the sheets 1 but is lifted in an appropriate inclination in a direction perpendicular to the forwarding direction. Consequently, an uppermost one of the accumulated sheets 1 carried on the lifting table 4 is normally contacted in a parallel relationship with the paper feed roller 15 and is thus forwarded smoothly by the feed roller 15.

Thus, in the present embodiment, the sheet supply device includes the single first take-up drum 50 and the single second take-up drum 51, which allows reduction in quantity of associated parts and simplification in construction. In addition, the overall size of the device can be attained.

Figure 10:
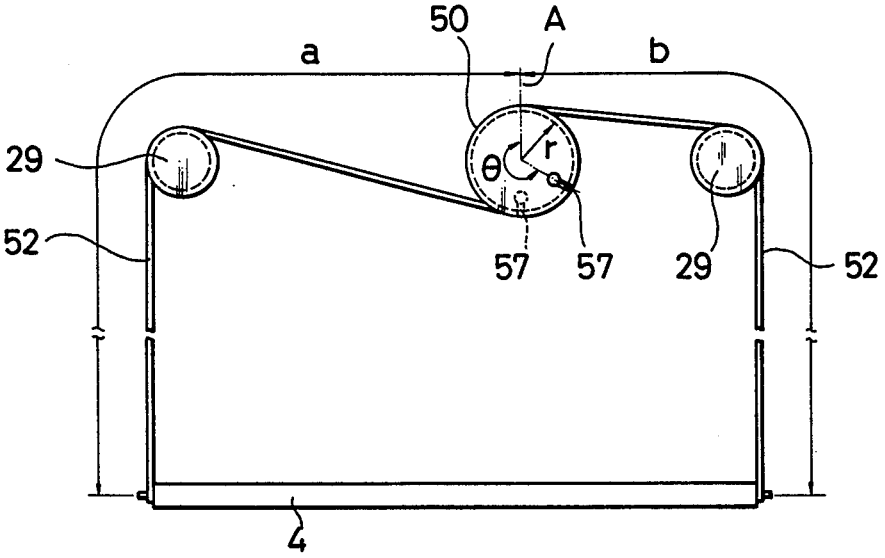
FIG. 10 is a similar view but illustrating a relation between a location of a take-up drum of a modified form and locations of portions of string members fastened to the take-up drum.
Figure 11:
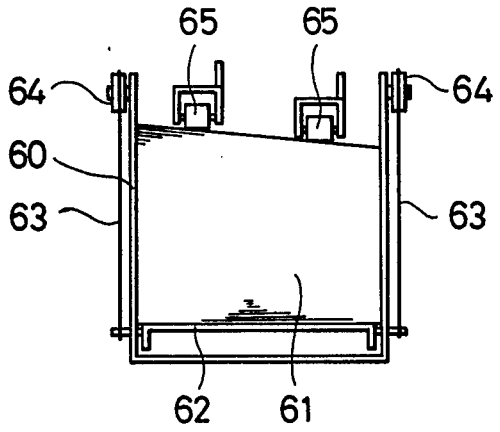
FIG. 11 (PRIOR ART)
FIG. 11 is a front elevational view showing a conventional sheet supply device.
Figure 12:
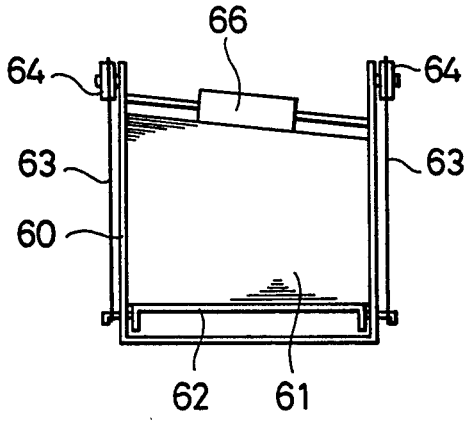
FIG. 12 (PRIOR ART)
FIG. 12 is a similar view but showing another conventional sheet supply device.

Meanwhile, since the first take-up drum 50 is mounted at a central portion of the support plate 5, it is spaced by an equal distance from the two pins 6. Accordingly, where the two string members 52 fastened to the two pins 6 have an equal length, locations on the first take-up drum 50 at which the string members 52 are secured are selected such that they are spaced by an angle of 180 degrees from each other around the center of the first take-up drum 50. This allows an axis passing through the two pins 6 of the lifting table 4 to be maintained in a horizontal position. To the contrary, where a location on the support plate 5 on which the first take-up drum 50 is mounted is displaced toward one end of the support plate 5 as shown in FIG. 10 which shows a modified form of a take-up drum and the two string members 52 still have an equal length, locations on the first take-up drum 50 at which the two string members 52 are fastened are displaced relative to each other. In particular, it is assumed that the distances from a reference line A perpendicularly passing the center of the first take-up drum 50 to the pins 6 are individually represented by a and b, and the radius of the first take-up drum 50 is represented by r. Then, the angular distance between locations on the first take-up drum 50 at which the two string members 52 are fastened is varied by an angle $\theta$ determined by a following equation $$\theta = |a-b|/r$$

from 180 degrees. Thus, an appropriate distance between the fastening locations of the two string members 2 is determined, and consequently inclination of the axis passing the two pins 6 of the lifting table 4 is prevented. This similarly applies to the second take-up drum 51 and the string members 53 fastened to the second take-up drum 51.

It is to be noted that, in actually working the present invention, the first take-up drums and the second take-up drums which are secured to the same or interconnected shafts in the first or second embodiment may otherwise be secured to independent shafts which are connected to be driven by independent lifting motors. In this instance, the lifting inclining means 31 may be constituted, for example, such that the taking up diameter of the first take-up drums is differentiated from that of the second take-up drums or such that the lifting motors are rotated at different speeds from each other, or else such two means may be employed in combination. Or alternatively, the lifting motors may be rotated at a same speed while gears for changing the driving speed are provided intermediately from the motors to the first and second take-up drums.

What is claimed is:

1. A sheet supply device, comprising:

a sheet stocker including a lifting table for receiving a large number of sheets accumulated in layers thereon, the sheets being different in thickness between opposite sides thereof, said sheet stocker further including a paper feed roller for contacting with an uppermost one of the sheets on said lifting table;

one or more string members having one end or ends fastened to each of opposite sides of said lifting table corresponding to the opposite sides of the sheets providing the difference in thickness;

a first take-up drum or drums located corresponding to the thicker side of the sheets and having the other end or ends of those of said string member or members corresponding to the thicker side of the sheets fastened thereto;

a second take-up drum or drums located corresponding to the thinner side of the sheets and having the other end or ends of those of said string member or members corresponding to the thinner side of the sheets fastened thereto; and a lifting inclining means for causing said first take-up drum or drums to take up the string member or members at a higher taking up speed than the taking up speed at which said second take-up drum or drums take up the string member or members.

2. A sheet supply device according to claim 1, wherein said first take-up drum or drums and said second take-up drum or drums are secured to a common shaft and the outer diameter of a take-up portion or portions of said first take-up drum or drums is made greater than the outer diameter of a take-up portion or portions of said second take-up drum or drums, thereby constituting said lifting inclining means.

3. A sheet supply device according to claim 1, wherein said first take-up drum or drums and said second take-up drum or drums are secured to a common shaft and the rotational speed of said first take-up drum or drums is made higher than the rotational speed of said second take-up drum or drums, thereby constituting said lifting inclining means.

4. A sheet supply device according to claim 3, wherein the rotational speeds of said first take-up drum or drums and said second take-up drum or drums are differentiated from each other by gear means.

5. A sheet supply device according to claim 3, wherein said first take-up drum or drums and said second take-up drum or drums are connected to be driven by independent motors the driving speeds of which are differentiated from each other in order to differentiate the rotational speeds of said first take-up drum or drums and second take-up drum or drums from each other.

6. A sheet supply device according to claim 1, wherein said sheet supply device comprises two first take-up drums and two second take-up drums, and four string members having one ends thereof fastened to opposite ends of opposite sides of said lifting table corresponding to the opposite sides of the sheets providing the difference in thickness, the other ends of said string members being fastened to said respective corresponding first and second take-up drums.

7. A sheet supply device according to claim 1, wherein said sheet supply device comprises a single first take-up drum and a single second take-up drum, and four string members having one ends fastened to opposite ends of opposite sides of said lifting table corresponding to the opposite sides of the sheets providing the difference in thickness, said first take-up drum and said second take-up drum each having the other ends of different two of said four string members fastened thereto.

8. A sheet supply device according to claim 7, wherein said first take-up drum and said second take-up drum each have two separate take-up portions for independently taking up thereon the two string members the other ends of which are fastened thereto.

9. A sheet supply device according to claim 7, wherein the two string members fastened to each of said first take-up drum and said second take-up drum have an equal length, and locations on said first take-up drum or said second take-up drum at which the two string members are secured to said first take-up drum or said second take-up drum are selected such that said lifting table may not be inclined in a sheet forwarding direction in response to a location of said first take-up drum or said second take-up drum on a line interconnecting and extended from two locations on said lifting table at which the two string members are fastened to said lifting table.

10. A sheet supply device according to claim 1, wherein said lifting table is lifted from a most lowered position to a most lifted position by one complete rotation of said first take-up drum or drums and said second take-up drum or drums.

11. A sheet supply device according to claim 1, wherein said sheet supply device further comprises a first pair of pins extending in a same direction with a sheet forwarding direction from opposite ends of one side of said lifting table corresponding to the thicker side of the sheets, a second pair of pins extending in the same direction with said first pair of pins from opposite ends of the other side of said lifting table, and a pair of holding walls having first guide slots for guiding said first pair of pins in a lifting direction of said lifting table and second guide slots for guiding said second pair of pins in the lifting direction of said lifting table, either said first guide slots or said second guide slots having a substantially same width with said first pins or said second pins while the other guide slots have a width greater that the width of said second pins or said first pins.

* * * * *